US008516615B2

(12) United States Patent
Di Giovanni et al.

(10) Patent No.: US 8,516,615 B2
(45) Date of Patent: Aug. 27, 2013

(54) PROTECTIVE GARMENT INCLUDING A MESH LINER LAYER

(75) Inventors: Anthony Di Giovanni, Montreal (CA); Stéphane Rousse, Pointe-Claire (CA)

(73) Assignee: Honeywell International, Inc., Morristown, NJ (US)

( * ) Notice: Subject to any disclaimer, the term of this patent is extended or adjusted under 35 U.S.C. 154(b) by 936 days.

(21) Appl. No.: 12/048,034

(22) Filed: Mar. 13, 2008

(65) Prior Publication Data

US 2008/0263744 A1 Oct. 30, 2008

Related U.S. Application Data

(60) Provisional application No. 60/894,772, filed on Mar. 14, 2007.

(51) Int. Cl.
*A62B 17/00* (2006.01)

(52) U.S. Cl.
USPC ..... 2/81; 2/85; 2/97

(58) Field of Classification Search
USPC ..... 2/81, 85, 93, 97, 98, 227, 457, 458
See application file for complete search history.

(56) References Cited

U.S. PATENT DOCUMENTS 3,086,215 A * 4/1963 Di Paola ..... 2/93
5,136,723 A * 8/1992 Aldridge et al. ..... 2/81
5,172,426 A * 12/1992 Capello ..... 2/81
5,406,648 A * 4/1995 Butzer et al. ..... 2/81
5,697,101 A * 12/1997 Aldridge ..... 2/81
5,720,045 A * 2/1998 Aldridge ..... 2/81
5,924,134 A * 7/1999 Taylor et al. ..... 2/81
6,263,510 B1 * 7/2001 Bay et al. ..... 2/93
6,427,242 B1 * 8/2002 Bush et al. ..... 2/69
6,430,754 B1 * 8/2002 Taylor et al. ..... 2/458
6,684,408 B2 * 2/2004 Rindle et al. ..... 2/108
6,898,803 B1 * 5/2005 Blauer et al. ..... 2/97
2001/0034897 A1 * 11/2001 Belcher ..... 2/458
2005/0229283 A1 * 10/2005 Towle et al. ..... 2/93
2006/0143809 A1 * 7/2006 Dunn ..... 2/458
2006/0260020 A1 * 11/2006 Seguin et al. ..... 2/93
2009/0077710 A1 * 3/2009 Bay ..... 2/87

OTHER PUBLICATIONS

STX Protective Apparel Inc., "Firegear Thermal Enhancement Options" (2 pages).
U.S. Appl. No. 60/894,772, filed Mar. 14, 2007, Di Giovanni et al.

* cited by examiner

*Primary Examiner* — Khoa Huynh
*Assistant Examiner* — Andrew W Collins
(74) *Attorney, Agent, or Firm* — Wood, Phillips, Katz, Clark & Mortimer

(57) ABSTRACT

A protective garment comprising an outer shell having an interior surface and an exterior surface. The protective garment further comprising a moisture barrier layer, a thermal insulating layer and a mesh liner layer. The thermal insulating layer comprises at least one of a facecloth material, a batting material, a spunlace material and a felt material, and the mesh liner layer is unattached to the thermal insulating layer.

23 Claims, 2 Drawing Sheets

PROTECTIVE GARMENT INCLUDING A MESH LINER LAYER

CROSS REFERENCE TO RELATED APPLICATIONS

This application claims the benefit under 35 USC §119(e) of U.S. provisional patent application Ser. No. 60/894,772 filed on Mar. 14, 2007 by Anthony Di Giovanni et al. The contents of the above-mentioned patent application are incorporated herein by reference.

FIELD OF THE INVENTION

The present invention relates to the field of protective garments, and more particularly to mesh liners used within protective garments for providing improved thermal resistance properties.

BACKGROUND OF THE INVENTION

Protective garments that are used in the emergency services industry are known to include a multi-layer construction, such that each layer in the multi-layer construction provides a different functionality to the protective garment. In the case of protective garments for firefighters, and specifically to firefighter jackets, three layers that are often present include an outer shell layer, a moisture barrier layer and a thermal insulating layer.

The purpose of the outer shell layer is to provide flame-resistance and abrasion resistance to the garment. The outer shell is typically made of a woven aramid or para-aramid material, such as Nomex® or Kevlar® that provides good thermal resistance. Aramid and para-aramid materials don't have a melting point, and instead simply decompose at extremely high temperatures, which makes them good materials for use in emergency protective wear. In addition, these materials provide good puncture and abrasion resistance to avoid debris or certain equipment from puncturing or tearing the material during use.

The moisture barrier layer is included within the protective garment in order to provide a semi-permeable membrane that allows moisture vapor to exit the protective garment but prevents liquid moisture from entering through the material. In this manner, the moisture barrier layer protects the wearer from getting wet as a result of water from the hoses or sprinklers.

The thermal insulating layer is intended to protect the wearer from external thermal conditions and is often made of a facecloth material that is quilted to a batting, spunlace or felt material. A deficiency with many thermal insulating layers is that they retain the heat and perspiration of the wearer. This can result in the garment becoming quite uncomfortable for a wearer. In addition, this moisture buildup within the thermal insulating layer can become quite heavy, which could potentially lead to the firefighters having to overexert themselves as they carry their equipment and climb up and down stairs.

The weight of a protective garment, as well as its breathability, are two important features for a firefighter. Generally speaking, the lighter the garment, the more comfortable it is to wear for the firefighter. In addition, its breathability helps to keep the firefighter's body temperature from elevating too much. The comfort and temperature experienced by the firefighter can drastically impact the firefighter's performance in an emergency situation, and as such is critical when considering the construction of a protective garment.

In light of the above, it can be seen that there is a need in the industry for a protective garment that alleviates, at least in part, the deficiencies of the prior art.

SUMMARY OF THE INVENTION

In accordance with a first broad aspect, the present invention provides a protective garment for positioning around a torso and arms of a wearer. The protective garment comprises an outer shell, a moisture barrier layer and a mesh liner layer. The outer shell comprising a torso covering portion and two sleeves, and the mesh liner layer is positioned between the outer shell and the moisture barrier layer. The mesh liner layer is made of a spun material.

In accordance with a second broad aspect, the present invention provides a protective garment comprising an outer shell having an interior surface and an exterior surface, a moisture barrier layer, a thermal insulating layer and a mesh liner layer. The thermal insulating layer comprises at least one of a facecloth material, a batting material, a spunlace material and a felt material. The mesh liner layer is unattached to the thermal insulating layer.

These and other aspects and features of the present invention will now become apparent to those of ordinary skill in the art upon review of the following description of specific embodiments of the invention and the accompanying drawings.

Other aspects and features of the present invention will become apparent to those ordinarily skilled in the art upon review of the following description of specific embodiments of the invention in conjunction with the accompanying figures.

DETAILED DESCRIPTION

Figure 1:
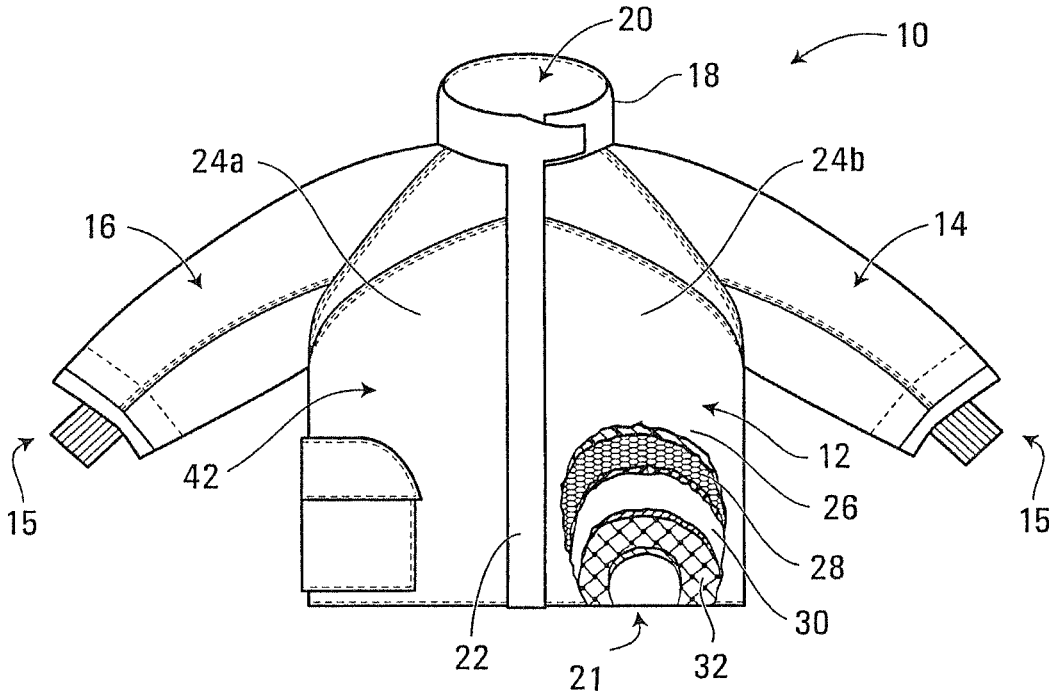
FIG. 1 shows a front view of a protective garment in accordance with a non-limiting example of implementation of the present invention, with a cut away portion to show different material layers.

Shown in FIG. 1 is a protective garment 10 in accordance with a non-limiting example of implementation of the present invention. In the embodiment shown, the protective garment is in the form of a fire-fighter jacket that has a torso covering portion 12, two sleeves 14 and 16, each having a respective cuff 15, a collar 18 that surrounds a neck opening 20 and a front opening/closure 22. The front opening/closure 22 extends from the neck opening 20 to a lower trunk opening 21 and enables a wearer to put on, and take off, the protective garment 10.

In FIG. 1, the protective garment 10 is shown with the frontal opening 22 in the closed position. The frontal opening 22 divides the front of the protective garment 10 into a first side 24*a* and a second side 24*b*. The frontal opening 22 can be closable via one or multiple fastening arrangements that include snaps, magnets, buckles, zippers and hook and loop fasteners, among other possibilities. The fastening arrangements help to prevent water, dirt and debris from entering the protective garment 10 while it is being worn by an emergency worker.

A portion of the protective garment 10 shown in FIG. 1 has been cut-away in order to show the material construction of the protective garment 10. As shown, the protective garment includes an outer shell 26, a mesh liner layer 28, a moisture barrier layer 30 and, optionally, an additional thermal insulating layer 32. The material and structure of each of these layers will now be described in more detail below, with reference to FIGS. 1 and 2.

The outer shell 26 is the outermost layer of the protective garment 10, and as such is preferably made out of an abrasion resistant material that provides cut, tear, and puncture resistance, as well as water and flame resistance. Some non-limiting examples of suitable materials for the outer shell 26 include materials made of tightly woven aramid or para-aramid materials, such as Nomex®, Kevlar®, a Nomex®/Kevlar® blend, a PBI®/Kevlar® blend or Millenia®.

The outer shell 26 is typically made of a single layer of material that includes an interior surface 40 (shown in FIG. 4) and an exterior surface 42 that together define the shape of the protective garment 10. As such, the torso covering portion 12, the two sleeves 14, 16, the cuffs 15, the front opening 22 and the collar 18 are all formed out of the material of the outer shell 26. In this manner, the inner layers (namely the mesh liner layer 28, the moisture barrier layer 30 and the optional thermal insulating layer 32) are simply internal layers that provide different protective properties to the protective garment 10.

In accordance with the present invention, positioned against the interior surface 40 of the outer shell 26 is a mesh liner layer 28. The mesh liner layer 28 includes a surface 44 that faces the interior surface 40 of the outer shell 26. As will be described in more detail below, the mesh liner layer 28 is included within the protective garment 10 in order to provide additional thermal resistance properties to the protective garment 10. This is done, at least in part, by creating an additional layer of air between the outer shell 26 and the wearer.

Figure 2:
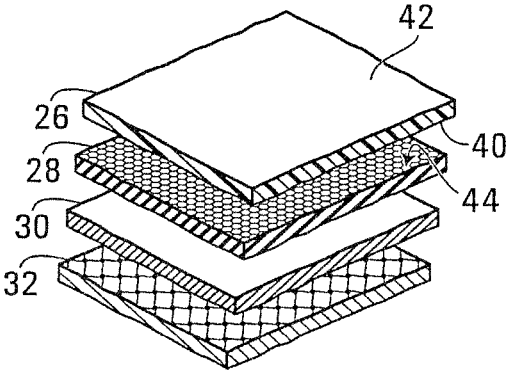
FIG. 2 shows an exploded view of a non-limiting set of materials used in the construction of the protective garment of FIG. 1.

Although only one mesh liner layer 28 is shown in FIGS. 1 and 2, it should be appreciated that multiple mesh liner layers 28 could be included within the protective garment 10 without departing from the spirit of the invention.

In accordance with a first non-limiting embodiment of the present invention, the mesh liner layer 28 is made from a spun material, which can be a spun para-aramid, spun meta-aramid and/or a spun meta-meta aramid. Some non-limiting examples of materials that can be used include spun Nomex® or spun Kevlar®. In addition, the mesh liner layer 28 can be made from other spun high temperature, fire resistant materials such as Kermel®, polybensimidazole (PBI), polyphenylenebenzobisozazole (PBO) or Triaminotriazine (Melamine Basofil®). Spun materials are made by twisting short stable fibres into a yarn, which creates a fluffier yarn with greater air spacing between the fibres than a filament material.

A first advantage of using a spun material is that it is less dense than a filament material. This reduced density means that the spun material is typically lighter, and less bulky, than the same material in filament format. As mentioned in the background of the invention, the lighter the protective garment 10, the better it is for the wearer. Increased weight in a protective garment 10 can increase the physical stress placed on an emergency worker and increase the chances the emergency worker will suffer from heat exhaustion. Therefore, in accordance with the present invention, the mesh liner layer 28 is made of a material that has a weight that is preferably less than 8.5 ounces per square yard. This can be measured using the ASTM D 3776 Standard Test Methods for Mass Per Unit Area (Weight) of Fabric. Broadly summarised, this method involves cutting (not tearing) a piece of fabric that is at least 10 inches in length from a roll, bolt or cut. The length and width of the conditioned, tension-free sample is taken and the sample is then weighed to the nearest 0.1% of its mass (weight). The mass per unit area is then calculated using the formula $oz/yd^2=45.72G/L_sW_s$ where G=mass of the specimen in grams, $L_s$=length of specimen in inches and $W_s$=width of specimen in inches. The value can then be converted into $g/m^2$, if required, using a unit conversion value.

In addition, the fact that a spun mesh is less dense than a mesh made of a filament material means that less material is required to make the spun mesh. This reduced amount of material translates into greater cost savings for the manufacturer of the protective garment 10 in terms of reduced material costs and creates a lighter mesh material. Finally, the fact that the spun mesh material is formed of a fluffy yarn means that there is more air trapped between the fibres. Air is known and recognised to be an effective insulator, and therefore, this less dense material provides improved thermal insulation over filament material. By including a mesh liner layer 28 that is made out of a spun material, significant thermal protection advantages are provided, without having to add significant weight to the protective garment 10.

Finally, the spun mesh material is more flexible than a filament mesh material. As such, the mesh liner layer 28 that is made from a spun fiber material is able to better conform to the movement of the wearer, thereby providing better mobility and comfort for a wearer of the protective garment 10.

In an alternative embodiment, the mesh liner layer 28 can also be made of a Kevlar® filament material.

Figure 3:
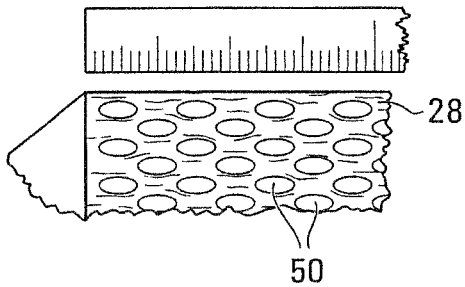
FIG. 3 shows a portion of the mesh liner material of FIG. 2 positioned against a ruler.

In accordance with the present invention, the mesh liner layer 28 includes relatively large holes 50 therein. More specifically, there are preferably between 56 to 90 holes per square inch. As shown in FIG. 3, which is not drawn to scale, in order to measure the holes 50 included within the mesh liner layer 28, two linear feet of the material should be spread out on a horizontal levelled surface. The material should be positioned on a surface that has a colour that contrasts with the colour of the mesh liner material, such that the holes are more visible. For example, in the case where the mesh liner material is black or dark brown, the material should be spread out on a white surface. Whereas, if the mesh liner material is white or a light cream, the material should be spread out on a black or dark brown surface.

Once the material has been spread out over the horizontal levelled surface, it should be left to sit for at least 12 hours so as to let the material shrink to its natural "at rest" state. After the material has been allowed to sit for the required length of time, the number of complete holes in a one linear foot section can be measured using a standard ruler. This measurement should be taken in the warp direction, and in the fill direction, in at least three different sections of the fabric, and multiplied together. Once these measurements have been taken, the average can be taken, and then divided by 144 in order to get the number of holes per square inch.

By having a mesh liner layer 28 with relatively large holes 50 included therein, the heat and moisture vapour generated by the wearer of the protective garment 10 can be conveyed away from the wearer quite quickly. In addition, the holes allow better breathability and circulation of the air and vapour that gets trapped within the protective garment 10, than compared with a garment that includes an additional layer of facecloth, batting, or felt insulation. This helps to prevent the wearer from overheating. In addition, the large holes 50 also allow less material to be used to create the mesh liner layer 28, which reduces the weight and the material costs of the mesh liner layer 28.

In light of the above, by including the mesh liner layer 28 according to the present invention within the protective garment 10, the thermal protective performance of the protective garment 10 is increased without adding a significant amount of weight to the protective garment 10.

The mesh liner layer 28 is capable of meeting the NFPA and TPP requirements. More specifically, the mesh liner layer 28 in accordance with the present invention increases the thermal protective performance of the protective garment 10 by at least 15 points compared to the same protective garment that does not include the mesh liner layer 28, when measured according to the TPP test method of NFPA 1971.

Referring back to FIGS. 1 and 2, positioned next to the mesh liner layer 28 is a moisture barrier layer 30. The moisture barrier layer 30 is impermeable to water, and is operative for providing liquid tight integrity from the elements. In certain non-limiting embodiments, the moisture barrier layer 30 can also prevent entry from chemicals and viral hazards and is impermeable to NFPA defined common chemicals and to blood and body-fluid borne pathogens. In addition, while preventing foreign liquid from entering the protective garment 10, the moisture barrier layer 30 also allows water vapour and metabolic heat that are built up by the perspiration and physical activity of the wearer, to escape. The material of the moisture barrier layer 30 can be a woven or a non-woven substrate to which a fire resistant semi-permeable polymer is coated or laminated. A non-limiting example of a material used for the moisture barrier layer 30 is CROSSTECH®), developed by W. L. Gore.

Finally, and as shown in FIGS. 1 and 2, positioned inwardly of the moisture barrier layer 30 is a thermal insulating layer 32. This thermal insulating layer 32 is an optional layer, and is preferably made of a fabric inner liner, such as a lightweight facecloth quilted to a batting, spunlace or felt. This thermal insulating layer 32 is able to absorb heat energy and provide significant resistance to the transmission of heat from the external environment to the body of the wearer.

In the case where the protective garment includes both the mesh liner layer 28 and the thermal insulating layer 32, the mesh liner layer 28 is separate from the thermal insulating layer 32. More specifically, the mesh liner layer 28 is unattached to the facecloth, batting, spunlace or felt of the thermal insulating layer 32, and is able to be loosely contained within the outer shell 26 of the protective garment 10. As such, the thermal insulating layer 32 provides a type of primary thermal insulating layer, and the mesh liner layer 28 provides a type of separate, secondary thermal insulating layer.

In an alternative embodiment, the moisture barrier layer 30 and the thermal insulating layer 32 can be combined into a single layer. That single layer would provide both the moisture barrier functionality and the thermal insulating functionality as described above with respect to the two separate layers 30 and 32.

As shown in FIGS. 1 and 2, the mesh liner layer 28 is positioned between the outer shell 26 and the moisture barrier layer 30. As such, the only water that should come into contact with the mesh liner layer 28 is from water passing through the outer shell 26. The fact that the mesh liner layer 28 includes large apertures and is made of a fluffy material, allows water to evaporate quite quickly from the mesh liner layer 28. The presence of absorbed water in the mesh liner layer 28 can greatly increase the possibility of injury, and when water is absorbed into the materials of the protective garment 10, it creates additional weight for the wearer of the protective garment 10, which in turn can lead to overheating or heat stress. As such, by positioning the mesh liner layer 28 between the outer shell 26 and the moisture barrier layer 30, where it should not come into contact with much water, improves the functionality of the overall protective garment 10.

Although the mesh liner layer 28 has been described herein above as being positioned between the outer shell 26 and the moisture barrier layer 30, it should be appreciated that in alternative embodiments, the mesh liner layer 28 may be included within the protective garment in other positions. For example, the mesh liner layer 28 could be positioned on the inside of the moisture barrier layer 30, such that the protective garment 10 includes, from the outside in, an outer shell 26, a moisture barrier layer 30 and then the mesh liner layer 28. The thermal barrier layer 32 may also, optionally, be included inwardly of that mesh liner layer 28. In yet a further non-limiting example, the mesh liner layer 28 may be positioned inwardly of the thermal barrier layer 32, such that from the outside in, the protective garment 10 includes an outer shell 26, a moisture barrier layer 30, the thermal barrier layer 32 and then the mesh liner layer 28.

In the case where the protective garment 10 does not include a thermal barrier layer 32, the garment 10 is more suitable for use as a search and rescue garment, or an emergency medical services garment, or a wildland fire fighter garment than a typical fire-fighter garment.

In accordance with a first non-limiting embodiment, and as shown in FIG. 1, the mesh liner layer 28 may line the entirety of the inner surface 40 of the outer shell 26. In such an embodiment, the mesh liner layer 28 is co-extensive with the outer shell 26 such that it extends along the torso covering portion 12 from the neck opening 20 to the trunk opening 21, and extends within the two sleeves 14 and 16 to the cuffs 15. As such, the outer shell 26 is fully lined with the mesh liner layer 28.

Figure 4:
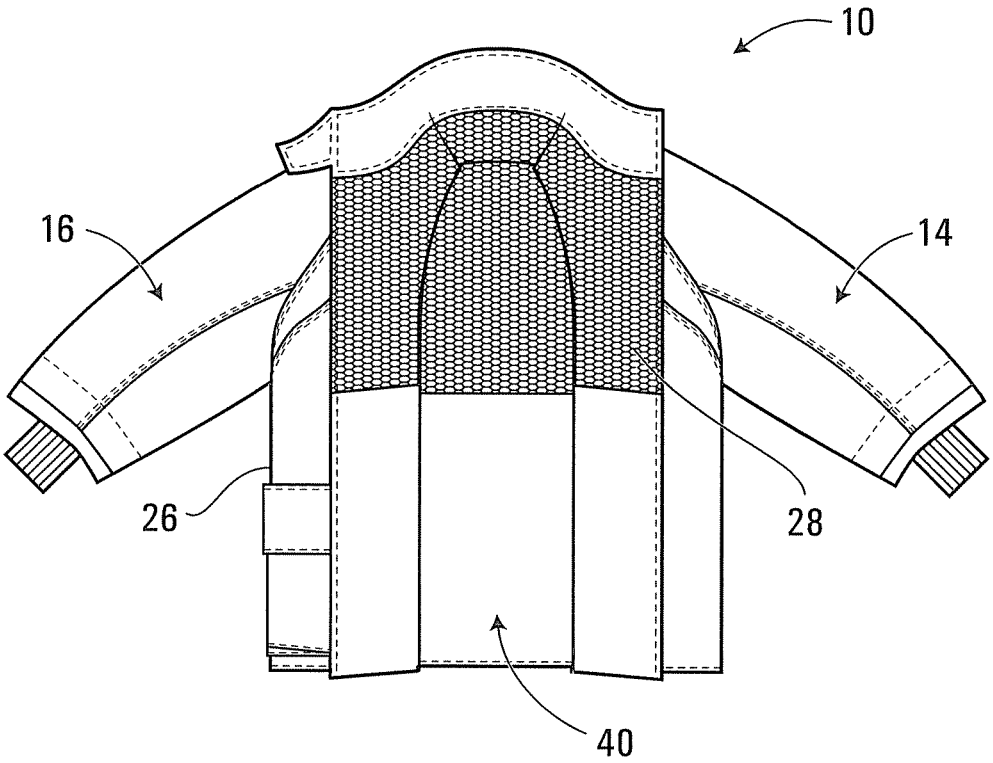
FIG. 4 shows a front view of the protective garment of FIG. 1 in an open position, without a moisture barrier layer.

Alternatively, in accordance with a second non-limiting embodiment that is shown in FIG. 4, the mesh liner layer 28 may only line a portion of the outer shell 26 of the protective garment 10. More specifically, the mesh liner layer 28 may only line the two sleeves 14, 16 and the upper section of the torso covering portion 12. In this manner, the thermal insulation benefits of the mesh liner layer 28 are still provided to the majority of the protective garment 10, but there is less weight than if the mesh liner layer 28 lined the entirety of the outer shell 26.

In accordance with a first non-limiting embodiment, the mesh liner layer 28 can be integrally formed into the protective garment 10. For example, the mesh liner layer 28 can be sewn into the outer shell 26 at the time of manufacture. More specifically, the mesh liner layer 28 can be sewn into the outer shell 26 of the protective garment 10 at the collar area around the neck opening portion 20 and around the cuffs 15. As such, the torso area of the mesh liner layer 28 generally just hangs within the torso area of the outer shell 26, such that it is loose and not secured to the outer shell 26 in this area. However, in alternative embodiments, the torso portion of the mesh liner layer 28 can be sewn into the torso area of the outer shell 26. In the case where the mesh liner layer 28 is integrally formed with the protective garment 10, it cannot be removed from the protective garment 10 without damaging the garment. It should be understood that in alternative embodiments, the mesh liner layer 28 can be attached to the outer shell 26 by adhering it, or by pressure sealing it to certain portions of the outer shell 26 , among other possibilities.

Figure 5:
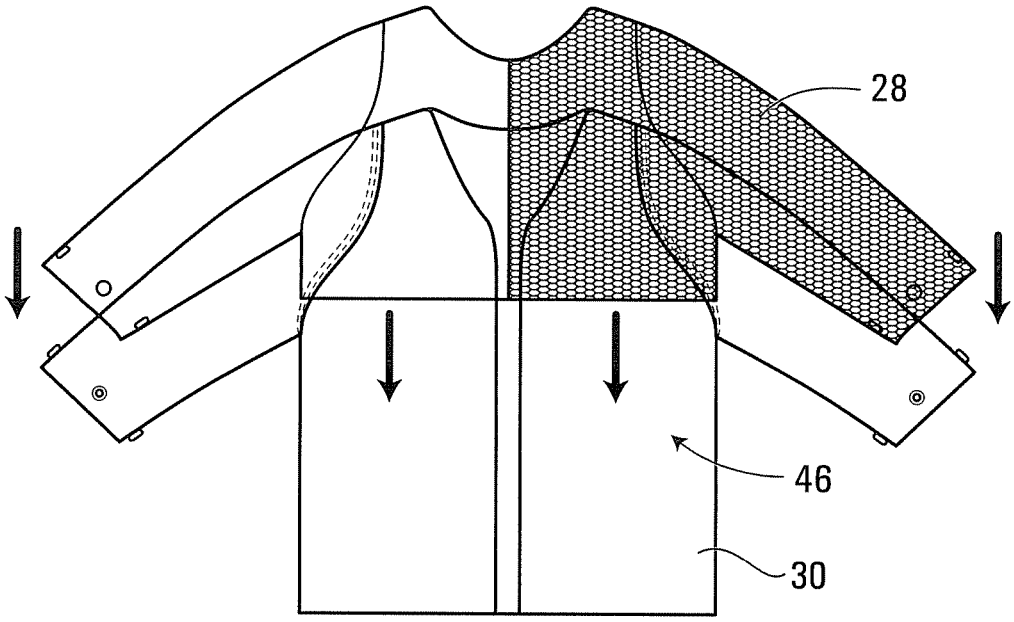
FIG. 5 shows a front view of a mesh liner layer positioned above a moisture barrier layer.

In an alternative embodiment, the mesh liner layer 28 can be removably attached to the protective garment 10. As such, the mesh liner layer 28 can be included within the protective garment 10 or can be removed from the protective garment 10 depending on the needs of the wearer. In the case where the mesh liner layer 28 is removably attached within the protective garment 10, it can be attached in a variety of different ways. For example, and as shown in FIG. 5, the mesh liner layer 28 can be designed to be positioned over the outer surface 46 of the moisture barrier layer 30 and then attached to the moisture barrier layer 30 via snaps and/or buttons that are located on the outer edge of the sleeves and collar. It should be appreciated that the mesh liner layer 28 could also be attached to the moisture barrier layer 30 via a zipper or a hook and loop arrangement, among other possibilities know in the art.

In addition, instead of the mesh liner layer 28 being attached to the outer surface of the moisture barrier layer 30, the mesh liner layer 28 could be attached to the inner surface 40 of the outer shell 26, as shown in FIG. 4. More specifically, the mesh liner layer 28 can be attached to the inner surface 40 of the outer shell 26 via snaps, buttons, zippers or one or more hook and loop arrangements, or a combination of these fasteners, among other possibilities.

By having the mesh liner layer 28 be removably attached to the protective garment 10, the wearer of the protective garment 10 can include the mesh liner layer 28 within the protective garment 10 or can chose to wear the protective garment 10 without the mesh liner layer 28 depending on the needs of the wearer. In the case where the emergency worker is a fire fighter, the fire fighter may chose to include the mesh liner layer 28 when he/she needs to extinguish a fire. However, when the fire-fighter is responding to a car accident, or other emergency situation that does not require as much thermal protection, then the fire-fighter may chose not to include the mesh liner layer 28 within the protective garment, so as to reduce the weight of the protective garment 10.

Although the mesh liner layer 28 described herein has been described in the context of a coat or a jacket, the mesh liner layer 28 can also be included within protective pants or trousers. More specifically, the mesh liner layer 28 can be included in a variety of different manners within a pair of protective pants or trousers. For example, in a first non-limiting embodiment, the mesh liner layer 28 could cover only the rear buttock region of the pair of protective pants, or trousers, so as not to add unnecessary weight to the garment. In a second non-limiting embodiment, the mesh liner layer 28 may extend throughout the upper portion of the pair of protective pants, such that the mesh liner layer 28 forms a pair of boxer-like shorts that surrounds the wearer's pelvic region and the wearer's upper thighs. In yet a further embodiment, the mesh liner layer 28 may line the entirety of the pair of protective pants, in both the front and the back, such that the protective pants are fully lined. Alternatively, the mesh liner layer 28 may cover the full length of the pair of protective pants in only the front or the back of the pant legs. As such, it should be appreciated that the mesh liner layer 28 may be included in all, or any part of, a pair of protective pants.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A protective garment for positioning around a torso and arms of a wearer, said protective garment comprising:

a) an outer shell comprising a torso covering portion and two sleeves;

b) a moisture barrier layer;

c) a mesh liner layer positioned between said outer shell and said moisture barrier layer, said mesh liner layer being made of a spun material, and having holes extending unimpeded through the mesh layer transverse to the mesh layer at each hole, wherein said torso covering portion comprises an upper portion and a lower portion, each portion extending vertically over at least 30 percent of the torso covering portion, said mesh liner layer being completely co-extensive only with said upper portion of said torso covering portion and said two sleeves of said outer shell.

2. A protective garment as defined in claim 1, further comprising a thermal insulating layer, said mesh liner layer being unattached to said thermal insulating layer.

3. A protective garment as defined in claim 2, wherein said thermal insulating layer comprises at least one of a facecloth material, a batting material, a spunlace material and a felt material.

4. A protective garment as defined in claim 3, wherein said thermal insulating layer is located between said moisture barrier layer and a wearer of said protective garment.

5. A protective garment as defined in claim 1, wherein said spun material includes at least one of a spun para-aramid, spun meta-aramid and a spun meta-meta aramid.

6. A protective garment as defined in claim 1, wherein said spun material includes at least one of a spun aramid material, a spun Triaminotriazine (Melamine Basofil®) material, a spun polybensimidazole (PBI) material, a spun polyphenylenebenzobisozazole (PBO) material and a spun Kermel.

7. A protective garment as defined in claim 1, wherein said mesh liner layer is made from a mesh material having between 56 and 90 holes per square inch.

8. A protective garment as defined in claim 1, wherein said mesh liner layer increases the thermal protective performance of said protective garment by at least 15 points compared to said protective garment without said mesh liner layer when measured according to the TPP (thermal protective performance) test method of NFPA 1971.

9. A protective garment as defined in claim 1, wherein said mesh liner layer has a weight of less than 8.5 ounces per square yard.

10. A protective garment as defined in claim 1, wherein said mesh liner layer is removable from said protective garment.

11. A protective garment comprising:

a) an outer shell having an interior surface and an exterior surface and comprising a torso covering portion and two sleeves;

b) a moisture barrier layer;

c) a thermal insulating layer comprising at least one of a facecloth material, a batting material, a spunlace material and a felt material; and d) a mesh liner layer, said mesh liner layer being unattached to said thermal insulating layer, and having holes extending unimpeded through the mesh layer transverse to the mesh layer at each hole, wherein said torso covering portion comprises an upper portion and a lower portion, each portion extending vertically over at least 30 percent of the torso covering portion, said mesh liner layer being completely co-extensive only with said upper portion of said torso covering portion and said two sleeves of said outer shell.

12. A protective garment as defined in claim 11, wherein said mesh liner layer is positioned between said outer shell and said moisture barrier layer.

13. A protective garment as defined in claim 12, wherein said thermal insulating layer is located between said moisture barrier layer and a wearer of said protective garment.

14. A protective garment as defined in claim 11, wherein said mesh liner layer is made from one of a spun material and a filament material.

15. A protective garment as defined in claim 11, wherein said mesh liner layer includes at least one of a para-aramid, spun meta-aramid and a spun meta-meta aramid material.

16. A protective garment as defined in claim 15, wherein said mesh liner layer includes at least one of a spun aramid material, a spun Triaminotriazine (Melamine Basofil®) material, a spun polybensimidazole (PBI) material, a spun polyphenylenebenzobisozazole (PBO) material and a spun Kermel.

17. A protective garment as defined in claim 11, wherein said mesh liner layer is made from a mesh material having between 56 and 90 holes per square inch.

18. A protective garment as defined in claim 11, wherein said mesh liner layer increases the thermal protective performance of said protective garment by at least 15 points compared to said protective garment without said mesh liner layer when measured according to the TPP (thermal protective performance) test method of NFPA 1971.

19. A protective garment as defined in claim 13, wherein said protective garment is a protective coat, said outer shell comprising a torso covering portion having a neck opening and two sleeves each having a respective cuff defining a hand opening.

20. A protective garment as defined in claim 19, wherein said mesh liner portion is connected to said outer shell in proximity to said neck opening and said respective cuffs, such that the majority of said mesh liner portion is loose within said protective garment.

21. A protective garment as defined in claim 20, wherein said mesh liner portion is connected to said outer shell via at least one of sewing, snaps, a hook and loop arrangement, buttons, and a zipper.

22. A protective garment as defined in claim 11, wherein said mesh liner layer is removable from said protective garment.

23. A protective garment as defined in claim 11, wherein said protective garment is a pair of protective pants.

* * * * *